US010011001B2

(12) United States Patent
Xue et al.

(10) Patent No.: US 10,011,001 B2
(45) Date of Patent: Jul. 3, 2018

(54) WHEEL BRUSH

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 73 days.

(21) Appl. No.: 15/364,448

(22) Filed: Nov. 30, 2016

(65) Prior Publication Data

US 2017/0182633 A1 Jun. 29, 2017

(51) Int. Cl.
*B24D 13/14* (2006.01)
*A46B 7/04* (2006.01)

(52) U.S. Cl.
CPC ..... *B24D 13/145* (2013.01); *A46B 7/04* (2013.01)

(58) Field of Classification Search
CPC ..... B24D 134/145; A46B 7/04; A46B 7/06; A46B 7/08; A46B 7/10; A46B 2200/3046; Y10T 403/7005; Y10T 403/7015; Y10T 403/7016
USPC ..... 451/532, 485, 486, 519, 514, 521, 359, 451/353; 403/348, 353, 354; 15/53.4
See application file for complete search history.

(56) References Cited

U.S. PATENT DOCUMENTS 1,538,220 A * 5/1925 Shultz ..... A46B 9/10 15/169
1,584,997 A * 5/1926 Shultz ..... A46B 9/10 15/197
2,332,936 A * 10/1943 Schlegel ..... A46B 13/008 15/230
4,037,369 A * 7/1977 Campbell ..... A46B 9/06 15/180
4,446,880 A * 5/1984 Gueret ..... A45D 40/265 132/218
5,011,230 A * 4/1991 Weihrauch ..... A46B 3/06 300/21
5,148,568 A * 9/1992 Bojar ..... A46B 7/08 15/28
5,221,123 A * 6/1993 Klinkhammer ..... A46B 3/00 264/243
5,249,760 A * 10/1993 Morimoto ..... A01K 89/01 242/279
5,707,278 A * 1/1998 Korn ..... B24B 33/08 300/21
6,126,533 A * 10/2000 Johnson ..... A46B 3/005 451/359

(Continued)

*Primary Examiner* — George Nguyen
(74) *Attorney, Agent, or Firm* — Calfee, Halter & Griswold LLP

(57) ABSTRACT

The present invention relates to a wheel brush, which is composed of a base plate, springs, chucks, iron sleeves and bristles. When a bristle unit is to be mounted, the iron sleeve of the bristle unit is placed on the upper side of the base plate, two anti-rotating lugs are made to correspond to two lug slots in the base plate, and the chuck is inserted from the lower side of the base plate; after a gasket is fixed in a counter bore in the lower side of the base plate, a wing nut is continuously pressed upwards, so that the spring is tensioned, and two guiding lugs of a fixing pin come into contact with the bottom ends of guiding slots in the iron sleeve; and after the wing nut is rotated by 90 degrees, the bristle unit can be locked.

3 Claims, 3 Drawing Sheets

(56) References Cited

U.S. PATENT DOCUMENTS

| | | | | |
|---|---|---|---|---|
| 6,312,323 | B1 * | 11/2001 | Warner | B24D 13/02 451/450 |
| 8,579,677 | B2 * | 11/2013 | Boudreau | B24D 3/28 451/28 |
| 8,702,335 | B2 * | 4/2014 | Young | F24J 2/5205 403/22 |
| 8,764,517 | B2 * | 7/2014 | Telischak, Jr. | B24B 23/02 451/359 |
| 9,357,831 | B2 * | 6/2016 | Jensen | B29C 45/14385 |
| 9,682,456 | B1 * | 6/2017 | McGeary | B24B 9/007 |
| 2001/0012753 | A1 * | 8/2001 | Cox | A46B 13/001 451/464 |
| 2003/0181154 | A1 * | 9/2003 | Fischer | A61C 3/06 451/532 |
| 2008/0160886 | A1 * | 7/2008 | Palushaj | A46B 13/008 451/353 |
| 2010/0051261 | A1 * | 3/2010 | Koleilat | E21B 17/07 166/177.5 |
| 2012/0023692 | A1 * | 2/2012 | Boucherie | A46B 3/06 15/207.2 |

* cited by examiner

WHEEL BRUSH

CROSS-REFERENCE TO RELATED APPLICATIONS

This application claims priority to Chinese Patent Application No. 201511006571.7, filed on Dec. 29, 2015, which is hereby incorporated by reference in its entirety.

TECHNICAL FIELD

The present invention relates to a burring brush, and in particular to a wheel brush convenient to change bristles.

BACKGROUND ART

In an aluminum alloy wheel production process, removal of burrs after machining is a very important working procedure. If an ideal effect cannot be achieved, it will often seriously affect the qualification rate of a subsequent coating working procedure. In order to meet the standard requirements, currently almost all manufacturing enterprises increase the rotation time of burring brushes on special devices, which seriously affects the service lives of the burring brushes. Therefore, it is necessary to realize convenient change of bristles of the burring brushes in order to save the production costs and achieve the repeated use of other components such as a base plate and the like.

SUMMARY OF THE INVENTION

An object of the present invention is to provide a wheel burring brush in which bristles can be quickly changed, and other components except the bristles can be repeatedly used.

To achieve the object described above, a technical solution of the present invention is as follows: a wheel brush is composed of a base plate, wing nuts, gaskets, springs, pull rods, fixing pins, iron sleeves and bristles. The bristles are adhered to the interior of one iron sleeve to form a bristle unit.

In one bristle unit, the upper end of the pull rod is welded to the lower side of the fixing pin; the two ends of the spring are welded to and fixed on the lower side of the fixing pin and the upper side of the gasket, respectively; the gasket sleeves the pull rod; the wing nut is welded to the lower side of the pull rod; and the wing nut, the gasket, the spring, the pull rod and the fixing pin form a chuck.

The bristle unit is fixed on the upper side of the base plate, and two guiding lugs of the fixing pin of the chuck are fixed to the lower side of the base plate after matching an annular groove in the iron sleeve.

Two anti-rotating lugs are arranged on the upper side of the iron sleeve and match two lug slots in the base plate. Two symmetrical guiding slots are formed in the lower side of the iron sleeve and match the two guiding lugs of the fixing pin.

During actual use, when the bristle unit is to be mounted, the iron sleeve of the bristle unit is placed on the upper side of the base plate, the two anti-rotating lugs are made to correspond to the two lug slots in the base plate, and the chuck is inserted from the lower side of the base plate; after the gasket is fixed in a counter bore in the lower side of the base plate, the wing nut is continuously pressed upwards, so that the spring is tensioned, and the two guiding lugs of the fixing pin come into contact with the bottom ends of the guiding slots in the iron sleeve; and after the wing nut is rotated by 90 degrees, the bristle unit can be locked; when the bristles are to be changed, only the wing nut needs to be rotated, and when the positions of the two guiding lugs of the fixing pin correspond to the positions of the two guiding slots in the iron sleeve, the fixing pin can be bounced out of the iron sleeve under the action of the spring.

When the wheel brush provided by the present invention is used, the bristles can be changed quickly, and other components except the bristles can be repeatedly used, so that the production costs can be reduced, and characteristics of advanced technique and simple structure are achieved.

Figure 1:
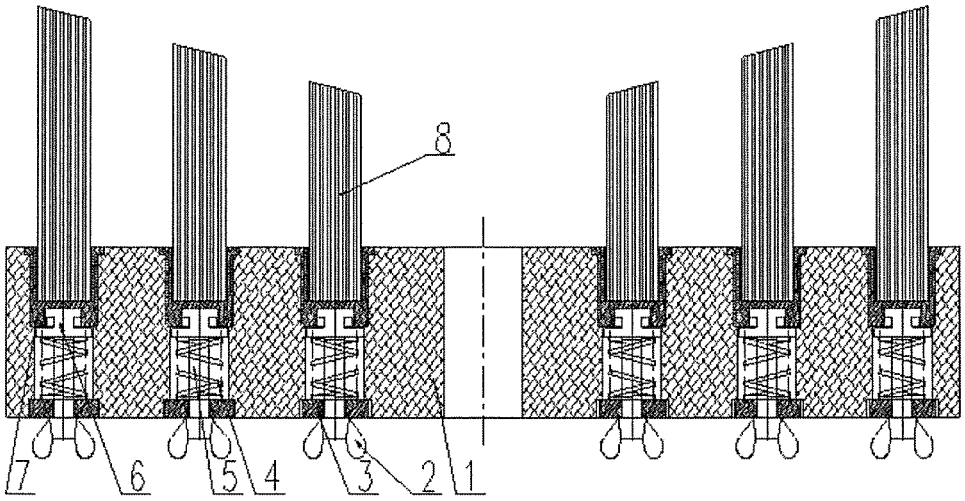
FIG. 1 is a front view of a wheel brush provided by the present invention.
Figure 2:
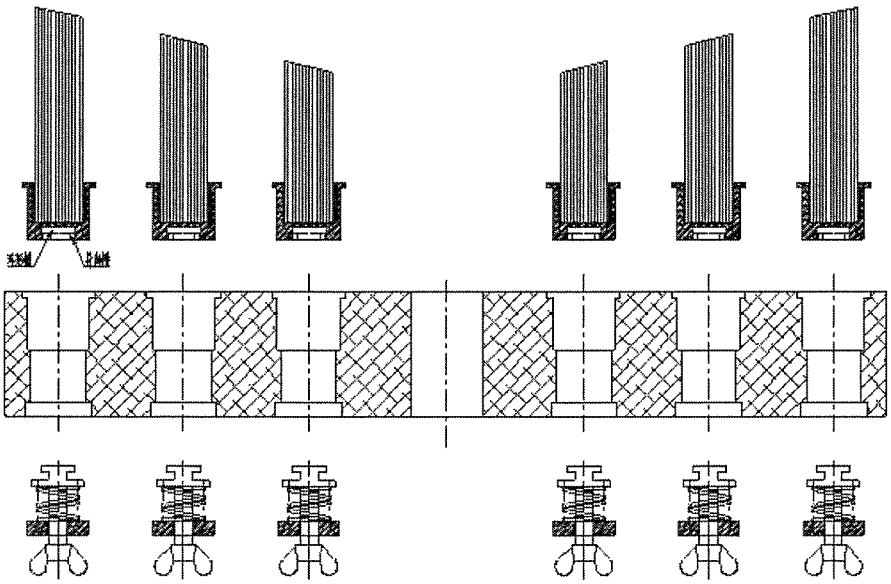
FIG. 2 is an exploded front view of the wheel brush provided by the present invention.
Figure 3:
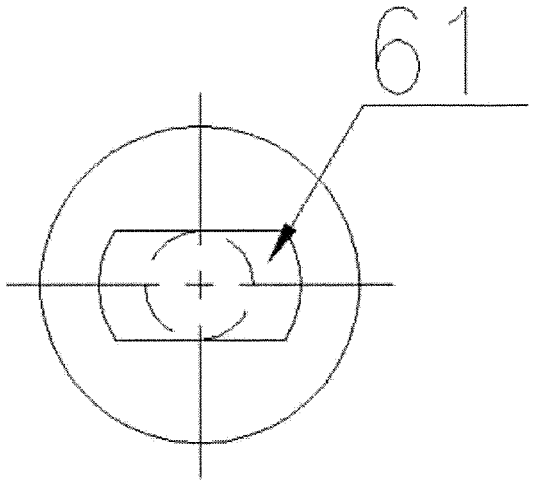
FIG. 3 is a top view of an iron sleeve of the wheel brush provided by the present invention.
Figure 4:
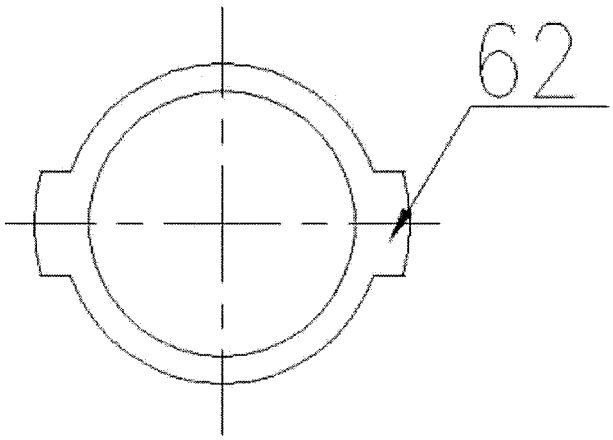
FIG. 4 is a top view of a fixing pin of the wheel brush provided by the present invention.
Figure 5:
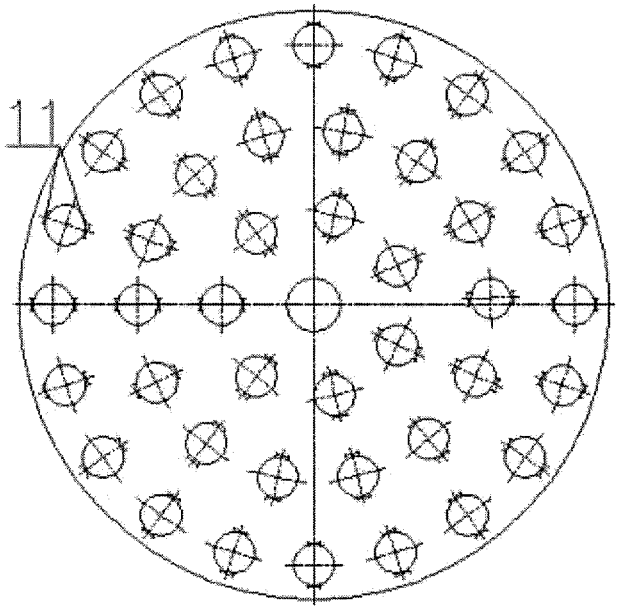
FIG. 5 is a top view of a base plate of the wheel brush provided by the present invention.

In the figures, numeric symbols are as follows: 1-base plate, 2-wing nut, 3-gasket, 4-spring, 5-pull rod, 6-fixing pin, 7-iron sleeve, 8-bristle, 11-lug slot, 61-guiding lug, and 62-anti-rotating lug.

DETAILED DESCRIPTION OF THE INVENTION

In the following, the details and working conditions of a specific device provided by the present invention are described in detail in combination with figures.

A wheel brush is composed of a base plate 1, wing nuts 2, gaskets 3, springs 4, pull rods 5, fixing pins 6, iron sleeves 7 and bristles 8. The bristles 8 are adhered to the interior of one iron sleeve 7 to form a bristle unit.

In one bristle unit, the upper end of the pull rod 5 is welded to the lower side of the fixing pin 6; the two ends of the spring 4 are welded to and fixed on the lower side of the fixing pin 6 and the upper side of the gasket 3, respectively; the gasket 3 sleeves the pull rod 5; the wing nut 2 is welded to the lower side of the pull rod 5; and the wing nut 2, the gasket 3, the spring 4, the pull rod 5 and the fixing pin 6 form a chuck.

The bristle unit is fixed on the upper side of the base plate 1, and two guiding lugs of the fixing pin 6 of the chuck are fixed on the lower side of the base plate 1 after matching an annular groove in the iron sleeve 7.

Two anti-rotating lugs are arranged on the upper side of the iron sleeve 7 and match two lug slots 11 in the base plate 1. Two symmetrical guiding slots are formed in the lower side of the iron sleeve 7 and match the two guiding lugs 61 of the fixing pin 6.

During actual use, when the bristle unit is to be mounted, the iron sleeve 7 of the bristle unit is placed on the upper side of the base plate 1, the two anti-rotating lugs 62 are made to correspond to the two lug slots 11 in the base plate 1, and the chuck is inserted from the lower side of the base plate 1; after the gasket 3 is fixed in a counter bore in the lower side of the base plate 1, the wing nut 2 is continuously pressed upwards, so that the spring 4 is tensioned, and the two guiding lugs 61 of the fixing pin 6 come into contact with the bottom ends of the guiding slots in the iron sleeve 7; and after the wing nut 2 is rotated by 90 degrees, the bristle unit can be locked; when the bristles 8 are to be changed, only the wing nut 2 needs to be rotated, and when the positions of the two guiding lugs 61 of the fixing pin 6 correspond to the positions of the two guiding slots in the iron sleeve 7, the fixing pin 6 can be bounced out of the iron sleeve 7 under the action of the spring 4.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wheel brush, comprising a base plate, wing nuts, gaskets, springs, pull rods, fixing pins, iron sleeves and bristles; characterized in that the bristles are adhered to the interior of one iron sleeve to form a bristle unit;

in one bristle unit, the upper end of the pull rod is welded to the lower side of the fixing pin; the two ends of the spring are welded to and fixed on the lower side of the fixing pin and the upper side of the gasket, respectively; the gasket sleeves the pull rod; the wing nut is welded to the lower side of the pull rod; and the wing nut, the gasket, the spring, the pull rod and the fixing pin form a chuck; and the bristle unit is fixed on the upper side of the base plate, and two guiding lugs of the fixing pin of the chuck are fixed to the lower side of the base plate after matching an annular groove in the iron sleeve.

2. The wheel brush according to claim 1, wherein two anti-rotating lugs are arranged on the upper side of the iron sleeve and match two lug slots in the base plate.

3. The wheel brush according to claim 1, wherein two symmetrical guiding slots are formed in the lower side of the iron sleeve and match the two guiding lugs of the fixing pin.

* * * * *